US010244303B2

(12) United States Patent
Xu et al.

(10) Patent No.: US 10,244,303 B2
(45) Date of Patent: Mar. 26, 2019

(54) IN-EAR BLUETOOTH HEADSET

(71) Applicant: SHENZHEN ATX TECHNOLOGY CO., LTD., Shenzhen (CN)

(72) Inventors: Mingqiang Xu, Shenzhen (CN); Yuechun Huang, Shenzhen (CN)

(73) Assignee: SHENZHEN ATX TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 15/960,556

(22) Filed: Apr. 24, 2018

(65) Prior Publication Data

US 2018/0242074 A1 Aug. 23, 2018

Related U.S. Application Data

(63) Continuation of application No. PCT/CN2017/081522, filed on Apr. 21, 2017.

(30) Foreign Application Priority Data

Sep. 27, 2016 (CN) ..... 2016 2 1083827 U

(51) Int. Cl.

| | |
|---|---|
| ***H04R 1/10*** | (2006.01) |
| ***H01Q 1/27*** | (2006.01) |
| ***H01Q 1/38*** | (2006.01) |
| ***H01Q 9/42*** | (2006.01) |
| *H01Q 1/44* | (2006.01) |
| *H01Q 1/48* | (2006.01) |

(52) U.S. Cl.

CPC ..... *H04R 1/1041* (2013.01); *H01Q 1/273* (2013.01); *H01Q 1/38* (2013.01); *H01Q 9/42* (2013.01); *H04R 1/1016* (2013.01); *H01Q 1/44* (2013.01); *H01Q 1/48* (2013.01); *H04R 2225/51* (2013.01); *H04R 2420/07* (2013.01)

(58) Field of Classification Search

CPC ... H04Q 1/44; H04Q 1/36; H04Q 1/48; H04R 25/00; H04R 1/106; H04R 2460/09; H04R 25/656

USPC ..... 381/74, 300

See application file for complete search history.

(56) References Cited

U.S. PATENT DOCUMENTS

| | | | | |
|---|---|---|---|---|
| 2009/0225997 | A1* | 9/2009 | Alves | H04M 9/082 381/66 |
| 2012/0329530 | A1* | 12/2012 | Zhu | H04M 1/05 455/570 |
| 2013/0100086 | A1* | 4/2013 | Kim | G06F 3/03545 345/179 |

* cited by examiner

*Primary Examiner* — Melur Ramakrishnaiah

(74) *Attorney, Agent, or Firm* — Im IP Law; C. Andrew Im; Chai Im

(57) ABSTRACT

An in-ear BLUETOOTH® headset antenna for single-ear and double-ear BLUETOOTH® headset. The antenna includes a radiation unit and a ground unit, both utilizing components that make up the headset. The radiation unit is composed of a horn of the BLUETOOTH® headset and a conductive foil attached to the horn surface. One end of the conductive foil is attached to the surface of the headset horn and the other end is connected to the feed point of the RF circuit antenna of the BLUETOOTH® headset. The ground unit includes copper pouring on a main printed circuit board connected to copper pouring a key printed circuit board by a cable. No additional antennas are required, and the in-ear BLUETOOTH® headset antenna reduces costs, saves space, and improves the radiation efficiency of the antenna due to the increased effective radiation area of the antenna.

20 Claims, 2 Drawing Sheets

IN-EAR BLUETOOTH HEADSET

RELATED APPLICATIONS

The present application is a continuation of the international application PCT/CN2017/081522 filed Apr. 21, 2017, which claims the benefit of CN201621083827.4 filed Sep. 27, 2016, each of which is incorporated herein by reference in its entirety.

FIELD OF THE INVENTION

The present invention relates to the technical field of BLUETOOTH® headset, in particular, to an in-ear BLUETOOTH® headset, which can be applied to the single-ear and double-ear BLUETOOTH® headset.

BACKGROUND OF THE INVENTION

Since the BLUETOOTH® headset is portable, people are happy to use it in various occasions, in particular, when they are in sports, they can listen to music and receive calls through BLUETOOTH® headsets, thus bringing great convenience to people in the sports process. So the requirements for the performance and appearance of BLUETOOTH® headsets are increasing. In order to increase the competitiveness of products, manufacturers have introduced BLUETOOTH® headsets of small size and metal housing to improve their portability and appearance, and attract more consumers.

The reduction in size and the addition of metal housing will inevitably increase the difficulty of antenna design. If the existing antenna designs, such as monopole antennas, IFA antennas, and loop antennas, are still used, the antenna performance may not meet the requirements and due to the strong vibration during exercise, the existing antenna design structure is not rigid and it is easily subject to vibrations and is deformed or even broken resulting in poor antenna performance. In addition, in the prior art, the antenna design adopts an independent antenna unit. Although its versatility is good, a certain clearance area is required to occupy a certain space in the headset, the cost is high, and the radiation efficiency of the antenna is low, which is not suitable for application on the in-ear BLUETOOTH® headset.

For this reason, it is necessary to research an antenna that is smaller in size, lower in cost, and is widely used in in-ear BLUETOOTH® headsets.

OBJECTS AND SUMMARY OF THE INVENTION

In order to solve above technical problem, the present invention provides an in-ear BLUETOOTH® headset, which does not require an independent antenna, saves space, has lower cost, has high radiation efficiency of the antenna and is conducive to widespread application.

According to one aspect of the present invention, an in-ear BLUETOOTH® headset is provided, which is applied to the single-ear and double-ear BLUETOOTH® headset. The antenna utilizes the components that make up the headset such as the horn, main PCB board, button PCB board and cable. An in-ear BLUETOOTH® headset, comprising a housing, a battery, a main printed circuit board, a headset control button printed circuit board, a speaker and an antenna, wherein: the housing covers the battery, the main printed circuit board, the headset control button printed circuit board, the speaker and the antenna; the battery, the main printed circuit board, the headset control button printed circuit board, the speaker and the antenna are operably electrically connected to each other; the antenna includes a radiation unit and a ground unit, which are arranged close to the outer surface of an existing part of the headset, and the length of the headset in the vertical direction is not increased by the antenna; the main printed circuit board includes a first surface and a second surface; the battery and the headset control button printed circuit board is placed on the first surface of the main printed circuit board; the speaker is placed on the second surface of the main printed circuit board; the headset control button circuit board and the main printed circuit board are are respectively located on both sides of the battery so that the battery is compactly enclosed between the headset control button circuit board and the main printed circuit board; the radiation unit is composed of an FPC (Flexible Printed Circuits) conductive metal foil attached to the surface of the speaker; the first end of the FPC conductive metal foil is attached to the outer surface of the speaker 8; the second end of the FPC conductive metal foil is conductively connected to the feed point of the RF circuit wire on the main printed circuit board; the ground unit consists of the copper pouring on the main printed circuit board and the copper pouring on the headset control button printed circuit board; the copper pouring on the main printed circuit board and the copper pouring on the headset control button printed circuit board are connected by a piece of cable; the length of cables of the copper pouring on the main printed circuit board and the copper pouring on the headset control button printed circuit board is 15~18 mm.

The antenna of the in-ear BLUETOOTH® headset works on the BLUETOOTH® 2.4 GHz frequency band, having a wide frequency band and high radiation efficiency.

Compared with the prior art, the in-ear BLUETOOTH® headset implementing the present invention has the following advantages:

1. No independent antenna unit is required;
2. Wide-band, high radiation efficiency;
3. This design saves space; and
4. Reduce costs.

BRIEF DESCRIPTION OF FIGURES

In order to clearly illustrate the embodiments of the present invention or the technical solution in the prior art, the drawings required for the description of the embodiments or the prior art will be briefly introduced hereafter. In all the drawings, the similar elements or parts are generally denoted with similar drawing marks. In the drawings, the elements and parts are not necessarily drawn in an actual proportion.

DETAILED DESCRIPTION OF THE EMBODIMENTS

The embodiments of technical solution of the present invention will be described in detail in connection with the attached drawings. The following embodiments only serve as examples to illustrate the technical solution of the invention and not be given to limit the scope of protection of the invention.

It shall be noted that unless otherwise mentioned, all technical and scientific terms used herein have the same meaning as commonly understood by a person skilled in the art to which the utility model belong.

Figure 1:
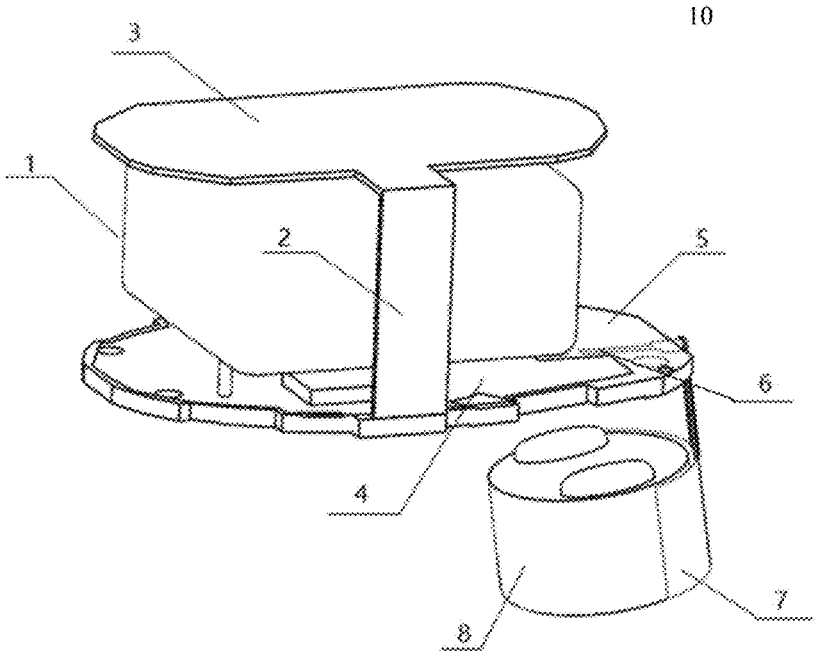
FIG. 1 is a structural view of the in-ear BLUETOOTH® headset antenna design according to the preferred embodiments of the present utility model.

According to one embodiment of the in-ear BLUETOOTH® headset, with reference to FIG. 1, the headset 10 comprises a housing (not shown), a battery 1, a main printed circuit board (PCB) 5, a headset control button printed circuit board 3, a speaker 8 and an antenna; the other parts are operatively connected to each other except for a housing that covers other parts. The main printed circuit board 5 includes a first surface and a second surface. In one embodiment, the battery 1 and the headset control button printed circuit board 3 are placed on the first surface of the main printed circuit board 5; the speaker 8 is placed on the second surface of the main printed circuit board 5; in one embodiment, the headset control button circuit board 3 and the main printed circuit board 5 are respectively located on both sides of the battery 1, that is, the battery 1 is compactly enclosed between the headset control button circuit board 3 and the main printed circuit board 5. In another embodiment, the headset control button printed circuit board are placed on the first surface of the main printed circuit board; the battery and the speaker are placed on the second surface of the main printed circuit board; in one embodiment, the main printed circuit board and the speaker are respectively located on both sides of the battery, that is, the battery is compactly enclosed between the main printed circuit board and the speaker. In one embodiment, the headset control button printed circuit board 3 is an FPC double-surface panel with a cable, the first surface of the double-surface panel being disposed with wires and the second surface being poured with copper.

The antenna includes a radiation unit and a ground unit. With continued reference to FIG. 1, the radiation unit and ground unit are arranged close to the outer surface of other parts of the headset 10 without occupying the space inside the headset 10 additionally. In one embodiment, the radiation unit is composed of an FPC conductive metal foil 7 attached to the surface of the speaker 8. In one embodiment, the radiation unit is electrically attached to the surface of the speaker 8; in another embodiment, the radiation unit is dielectrically attached to the surface of the speaker 8. One end of the FPC conductive metal foil 7 is attached to the outer surface of the speaker 8; the other end is conductively connected to the feed point 6 of the RF circuit wire on the main printed circuit board 5. In one embodiment, the ground unit consists of the copper pouring 4 on the main printed circuit board 5 and the copper pouring on the headset control button printed circuit board 3. In one embodiment, the copper pouring 4 on the main printed circuit board 5 and the copper pouring on the headset control button printed circuit board 3 are connected by a piece of cable 2. In one embodiment, the length 7 of cables of the copper pouring on the main printed circuit board 5 and the copper pouring on the headset control button printed circuit board 3 is from 15 to 18 mm; preferably, the length of the cable is 16 mm.

Figures 2A, 2B:
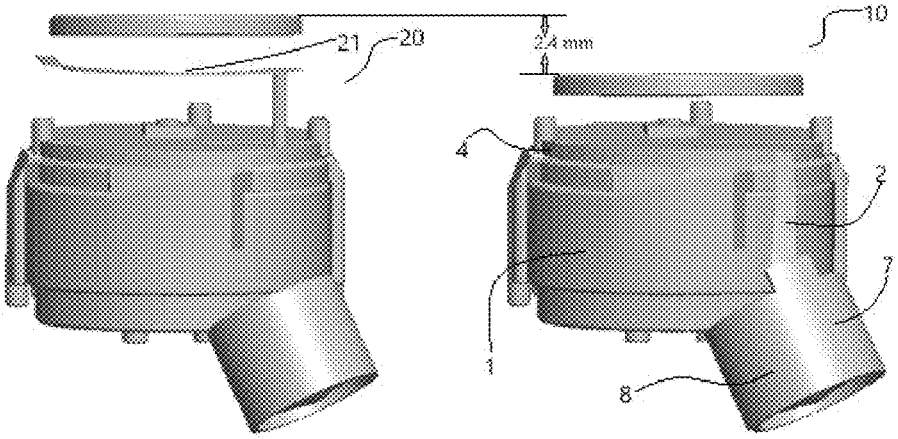
FIG. 2A illustrates an in-ear BLUETOOTH® headset in the prior art, in which a complex metal sheet is designed as an independent antenna unit.
FIG. 2B is an in-ear BLUETOOTH® headset embodying the present invention, in which the size of the headset needs not to be reduced as the space needs not to be reserved for the antenna unit.

With reference to FIG. 2A, the in-ear BLUETOOTH® headset 20 in the prior art adopts a complex metal sheet 21 as an independent antenna. In the in-ear BLUETOOTH® earphone 20, a space must be reserved for the independent antenna, thereby increasing the size of the in-ear BLUETOOTH® headset 20. FIG. 2B is an in-ear BLUETOOTH® headset 10 embodying the present invention. Since the antenna 2 is attached to the surface of other parts of the in-ear BLUETOOTH® headset 10, it is no longer necessary to reserve space for the antenna 2 to so that the in-ear BLUETOOTH® headset 10 implementing the present invention is at least 2.4 mm smaller in vertical height than the in-ear BLUETOOTH® headset 20 in the prior art. Since the antenna is no longer provided with a complicatedly constructed metal sheet, the production cost per ear of the in-ear BLUETOOTH® headset 10 implementing the present invention is expected to be reduced by 0.2 US dollars.

The BLUETOOTH® headset antenna design of the present invention is not limited to the above-described embodiments. It can be understood that various variations and modifications can be made without departing from the spirit and the scope of the present invention to achieve the same or optimized purpose. For example, the main printed circuit board 5, the headset control button printed circuit board 3, and the cable 7 are made of an integrated hard-flex board or the like.

At last, it should be illustrated that the above various embodiments are only used to illustrate the technical schemes of the present invention without limitation; and despite reference to the aforementioned embodiments to make a detailed description for the present invention, the ordinary technical personnel in this field should understand: the described technical scheme in above various embodiments can be modified or the part of or all technical features can be equivalently substituted; while these modifications or substitutions do not make the essence of their corresponding technical schemes deviate from the scope of the technical schemes of the embodiments of the present invention, all of which should be contained within the scope of the claims and description of the present invention.

What is claimed is:

1. An in-ear BLUETOOTH headset comprising a housing, a battery, a main printed circuit board, a headset control button printed circuit board, a speaker and an antenna; wherein:

the housing covers the battery, the main printed circuit board, the headset control button printed circuit board, the speaker and the antenna;

the battery, the main printed circuit board, the headset control button printed circuit board, the speaker and the antenna are operably electrically connected to each other;

the antenna comprises a radiation unit and a ground unit, which are arranged close to an outer surface of an existing part of the headset;

a length of the headset in a vertical direction is not increased by the antenna; and wherein the headset control button printed circuit board is an FPC double-surface panel with a cable, a first surface of the double-surface panel being disposed with wires and a second surface being poured with copper.

2. The in-ear BLUETOOTH headset according to claim 1, wherein the existing part of the headset is at least one of the battery, the main printed circuit board, the headset control button printed circuit board and the speaker.

3. The in-ear BLUETOOTH headset according to claim 2, wherein:

the radiation unit is composed of an FPC conductive metal foil attached to a surface of the speaker;

a first end of the FPC conductive metal foil is attached to the surface of the speaker; and a second end of the FPC conductive metal foil is conductively connected to a feed point of a RF circuit wire on the main printed circuit board.

4. The in-ear BLUETOOTH headset according to claim 3, wherein the radiation unit is electrically attached to the surface of the speaker.

5. The in-ear BLUETOOTH headset according to claim 3, wherein the ground unit comprises a first copper pouring on the main printed circuit board and a second copper pouring on the headset control button printed circuit board.

6. The in-ear BLUETOOTH headset according to claim 5, wherein the first copper pouring on the main printed circuit board and the second copper pouring on the headset control button printed circuit board are connected by a cable.

7. The in-ear BLUETOOTH headset according to claim 6, wherein a length of the cable connecting the first copper pouring on the main printed circuit board and the second copper pouring on the headset control button printed circuit board is from 15 to 18 mm.

8. The in-ear BLUETOOTH headset according to claim 7, wherein the length of the cable connecting the first copper pouring on the main printed circuit board and the second copper pouring on the headset control button printed circuit board is 16 mm.

9. The in-ear BLUETOOTH headset according to claim 1, wherein:

the main printed circuit board comprises a first surface and a second surface;

the battery and the headset control button printed circuit board is disposed on the first surface of the main printed circuit board;

the speaker is disposed on the second surface of the main printed circuit board; and the headset control button circuit board and the main printed circuit board are respectively located on both sides of the battery so that the battery is compactly enclosed between the headset control button circuit board and the main printed circuit board.

10. An in-ear BLUETOOTH headset comprising a housing, a battery, a main printed circuit board, a headset control button printed circuit board, a speaker and an antenna; wherein:

the housing covers the battery, the main printed circuit board, the headset control button printed circuit board, the speaker and the antenna;

the battery, the main printed circuit board, the headset control button printed circuit board, the speaker and the antenna are operably electrically connected to each other;

the antenna comprises a radiation unit and a ground unit, which are arranged close to an outer surface of an existing part of the headset, and a length of the headset in a vertical direction is not increased by the antenna;

the existing part of the headset is at least one of the battery, the main printed circuit board, the headset control button printed circuit board and the speaker; and the ground unit comprises a first copper pouring on the main printed circuit board and a second copper pouring on the headset control button printed circuit board.

11. The in-ear BLUETOOTH headset according to claim 10, wherein the first copper pouring on the main printed circuit board and the second copper pouring on the headset control button printed circuit board are connected by a cable.

12. The in-ear BLUETOOTH headset according to claim 11, wherein a length of the cable connecting the first copper pouring on the main printed circuit board and the second copper pouring on the headset control button printed circuit board is from 15 to 18 mm.

13. The in-ear BLUETOOTH headset according to claim 12, wherein the length of the cable connecting the first copper pouring on the main printed circuit board and the second copper pouring on the headset control button printed circuit board is 16 mm.

14. The in-ear BLUETOOTH headset according to claim 10, wherein the radiation unit is conductively attached to a surface of the speaker.

15. An in-ear BLUETOOTH headset comprising a housing, a battery, a main printed circuit board, a headset control button printed circuit board, a speaker and an antenna; wherein:

the housing covers the battery, the main printed circuit board, the headset control button printed circuit board, the speaker and the antenna;

the battery, the main printed circuit board, the headset control button printed circuit board, the speaker and the antenna are operably electrically connected to each other;

the antenna comprises a radiation unit and a ground unit, which are arranged close to an outer surface of an existing part of the headset, and a length of the headset in a vertical direction is not increased by the antenna;

the main printed circuit board comprises a first surface and a second surface;

the battery and the headset control button printed circuit board is disposed on a first surface of the main printed circuit board;

the speaker is disposed on a second surface of the main printed circuit board;

the headset control button circuit board and the main printed circuit board are respectively located on both sides of the battery so that the battery is compactly enclosed between the headset control button circuit board and the main printed circuit board;

the radiation unit is composed of an FPC conductive metal foil attached to a surface of the speaker;

a first end of the FPC conductive metal foil is attached to the surface of the speaker;

a second end of the FPC conductive metal foil is conductively connected to a feed point of a RF circuit wire on the main printed circuit board; and the ground unit comprises a first copper pouring on the main printed circuit board and a second copper pouring on the headset control button printed circuit board.

16. The in-ear BLUETOOTH headset according to claim 15, wherein the first copper pouring on the main printed circuit board and the second copper pouring on the headset control button printed circuit board are connected by a cable.

17. The in-ear BLUETOOTH headset according to claim 16, wherein a length of the cable connecting the first copper pouring on the main printed circuit board and the second copper pouring on the headset control button printed circuit board is from 15 to 18 mm.

18. The in-ear BLUETOOTH headset according to claim 17, wherein the length of the cable connecting the first copper pouring on the main printed circuit board and the second copper pouring on the headset control button printed circuit board is 16 mm.

19. The in-ear BLUETOOTH headset according to claim 15, wherein the radiation unit is conductively attached to the surface of the speaker.

20. An in-ear BLUETOOTH headset comprising a housing, a battery, a main printed circuit board, a headset control button printed circuit board, a speaker and an antenna; wherein:

the housing covers the battery, the main printed circuit board, the headset control button printed circuit board, the speaker and the antenna;

the battery, the main printed circuit board, the headset control button printed circuit board, the speaker and the antenna are operably electrically connected to each other;

the antenna comprises a radiation unit and a ground unit, which are arranged close to an outer surface of an existing part of the headset;

a length of the headset in a vertical direction is not increased by the antenna;

the main printed circuit board comprises a first surface and a second surface;

the battery and the headset control button printed circuit board is disposed on the first surface of the main printed circuit board;

the speaker is disposed on the second surface of the main printed circuit board; and the headset control button circuit board and the main printed circuit board are respectively located on both sides of the battery so that the battery is compactly enclosed between the headset control button circuit board and the main printed circuit board.

* * * * *